United States Patent [19]

Igel

[11] Patent Number: 4,823,544

[45] Date of Patent: Apr. 25, 1989

[54] PROCESS AND APPARATUS FOR JOB CONTROL OF SERVICING ELEMENTS AT A TEXTILE SPINNING INSTALLATION

[75] Inventor: Wolfgang Igel, Ebersbach/Fils, Fed. Rep. of Germany

[73] Assignee: Zinser Textilmaschinen GmbH, Fed. Rep. of Germany

[21] Appl. No.: 146,937

[22] Filed: Jan. 22, 1988

[30] Foreign Application Priority Data

Jan. 22, 1987 [DE] Fed. Rep. of Germany ..... 3701796

[51] Int. Cl.[4] ..... D01H 13/32; D01H 13/14

[52] U.S. Cl. ..... 57/265; 57/264

[58] Field of Search ..... 57/264, 265, 266, 268, 57/274, 276, 281; 242/35.5 A, 35.5 R

[56] References Cited

U.S. PATENT DOCUMENTS

| | | | |
|---|---|---|---|
| 4,136,511 | 1/1979 | Raasch | 57/265 |
| 4,150,533 | 4/1979 | Gasser et al. | 57/265 |
| 4,194,349 | 3/1980 | Lane | 57/265 |
| 4,292,800 | 10/1981 | Werst | 57/264 |
| 4,425,754 | 1/1974 | Lane | 57/265 |
| 4,665,686 | 5/1987 | Sumner et al. | 57/264 |

FOREIGN PATENT DOCUMENTS

| | | |
|---|---|---|
| 0026111 | of 0000 | European Pat. Off. . |
| 126373 | 11/1984 | European Pat. Off. . |
| 1800434 | of 0000 | Fed. Rep. of Germany . |
| 2034984 | of 0000 | Fed. Rep. of Germany . |
| 2502426 | of 0000 | Fed. Rep. of Germany . |
| 2712700 | of 0000 | Fed. Rep. of Germany . |
| 3524073 | of 0000 | Fed. Rep. of Germany . |
| 3135333 | 9/1981 | Fed. Rep. of Germany . |

*Primary Examiner*—Donald Watkins

*Attorney, Agent, or Firm*—Shefte, Pinckney & Sawyer

[57] ABSTRACT

A process and apparatus for job control of servicing elements at a spinning installation with a plurality of servicing points, wherein existing servicing cases are detected and analyzed for correction control by a central control unit. Existing servicing cases are automatically detected separately according to number and correction requirement and, depending on number and degree of difficulty of the sevicing cases detected, a job instruction signal of one of at least two signal stages is transmitted to a corresponding associated servicing element according to a predetermined ranking of the servicing elements. The apparatus has a summing device for summing existing servicing cases, a comparator for comparing the sum of existing servicing cases with a preset number of servicing cases, and at least one indicator connected with both the comparator and the detector, the indicator being capable of at least two indication stages as a function of the servicing element required for correcting the servicing cases detected.

21 Claims, 1 Drawing Sheet

PROCESS AND APPARATUS FOR JOB CONTROL OF SERVICING ELEMENTS AT A TEXTILE SPINNING INSTALLATION

BACKGROUND OF THE INVENTION

The invention relates to a process and an apparatus for job control of servicing elements at a textile spinning installation with a plurality of servicing points, wherein existing servicing cases are detected and analyzed for correction control by a central control unit.

German Published Patent Application No. 3,135,333 discloses a process for job control of an operator or a mobile service apparatus in a textile spinning installation having a plurality of servicing points, wherein servicing cases that occur are detected by type location and are transmitted to a central data storage. The central data storage is queried about servicing cases that have occurred according to the priority of their servicing need, and at least the location and possibly also the type of servicing case are transmitted to an operator or a mobile service apparatus as the point to be serviced. The central data storage thus stores all data connected with servicing actions. An interrogation apparatus queries the central data storage for all data necessary for determination of the stations to be serviced first and feeds this information to a transmitter. The instructions are communicatetd by radio to a receiver carried by the operator or to the mobile service apparatus and the point to be serviced is indicated to the operator by audible or optical means or the service apparatus is directed to this station. This process increases the efficiency of the operator and the mobile service apparatus, but the existing servicing cases are not automatically detected separately according to number and correction requirement.

It is also known to detect broken strand ends in a spinning installation by sections of spinning stations with indicator lamps being provided to guide operators to the station or stations requiring service. However, the main advantage of this arrangement is only to shorten the distance the operators must travel.

SUMMARY OF THE INVENTION

It is accordingly an object of the present invention, on the other hand, to provide a process and an apparatus for job control of servicing elements at a spinning installation that further increases efficiency and makes it possible to differentiate between existing servicing cases.

This objective is achieved according to the process of the present invention by ranking the servicing elements according to their respective capabilitites for correcting differing servicing cases. Existing servicing cases are automatically detected separately according to number and correction requirement, and, depending on number and degree of difficulty of the servicing cases detected, a job instruction signal is transmitted to the servicing cases detected. The job instruction signal is one of at least two signal stages each of which is respectively associated with a corresponding one of the ranked servicing elements. The apparatus for carrying out the process of the present invention utilizes a summing device for summing existing servicing cases, a comparator for comparing the sum of existing servicing cases with a present number of servicing cases, detecting means for detecting existing servicing cases separately according to number and correction requirement, and at least one indicator connected with both the comparator and the detecting means, the indicator having at least two indication stages which are convertable or switchable as a function of the servicing element required for correcting the servicing cases detected.

According to the preferred embodiment of the present invention, the signal stage of the job instruction signal transmitted for a detected service case is determined according to the ranking of the servicing element having the servicing capability required for qualitatively correcting the detected servicing case. Where a number of servicing cases are detected, the signal stage is determined according to the ranking of the servicing element having the servicing capability for quantitatively correcting the detected servicing cases. When the servicing element of one rank is unavailable, the signal stage associated with the unavailable servicing element is converted into the signal stage of the servicing element of the next higher ranking. Preferably, a graduated three-stage ranking of the servicing elements is provided, including, for example an automatic traveling servicing unit as the lowest ranking servicing element, an operator as the next ranking servicing element, and a supervisor as the highest ranking servicing element.

In the preferred embodiment of the apparatus of the present invention, the detecting means includes sensors arranged at each servicing point for sensing existing servicing cases. A timer may be provided for measuring the cycle time of one of the servicing elements utilized for correcting servicing cases. A detector may also be provided for detecting servicing cases which are not correctable by the servicing element of the lowest rank, this detector including means for reporting a servicing case is uncorrectable by the lowest ranking servicing element after a predetermined number of unsuccessful servicing attempts, preferably between two and five such attempts. Another detector, preferably in the form of an operator-actuated switch, is provided for detecting servicing cases which cannot be corrected by an operator.

The sensors of the detecting means are preferably connected operably with the indicator through the summing means. A preselector is operatively connected with the comparator for setting its preset number of servicing cases. The detecting means may be arranged for supplying servicing instructions to the transmitting means separately by sections of the spinning installation.

The spinning installation may have a plurality of spinning stations each of which utilizes a drafting system with delivery rollers. In this case, detecting means may include a coil sensor at each spinning station for sensing coil build-up at the delivery rollers with the coil sensors being connected with the indicator to separately indicate the number and the types of servicing cases ascertained by the coil sensors.

One of the servicing elements may be an automatic traveling service unit arranged for movement along the spinning installation, e.g., an automatic strand piecing unit or an automatic roving bobbin exchange unit. The traveling service unit is operatively connected with the indicator to separately indicate the number and the types of servicing cases ascertained by the traveling service unit. A slide contact may be mounted to the traveling service unit for contact with a separate busbar mounted along the spinning installation in operative connection with the indicator. Alternatively, a means may be provided for transmitting high frequency signals from the traveling service unit to the indicator. Also, a printer may be operatively connected with the indicator to record operating data.

DESCRIPTION OF THE PREFERRED EMBODIMENT

Figure 1:
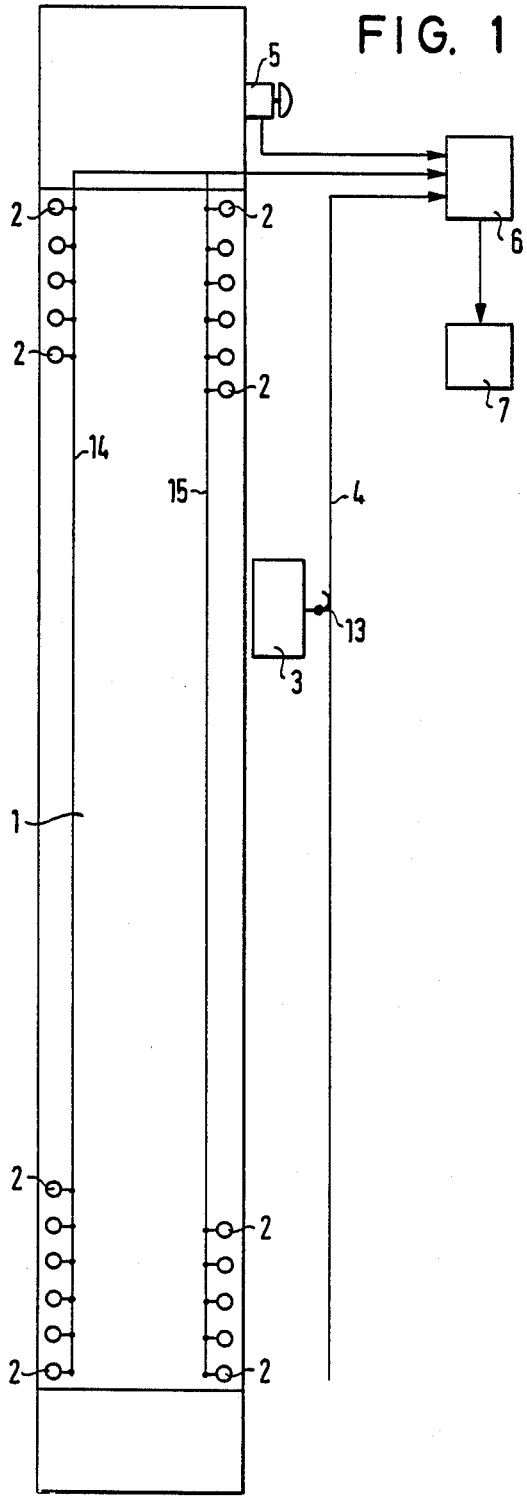
FIG. 1 is a schematic plan view of a ring spinning machine with an apparatus according to the present invention for carrying out the present method of automatic and separate detection of existing servicing cases by thread break sensors.

While the operating characteristics of the present invention are hereinafter explained in conjunction with an automatic piecing device, those persons of ordinary skill in the art will readily recognize that the disclosure herein of this embodiment of the present invention is not to be considered as a limitation of the scope of the present invention to such traveling service units. For example, the present invention may also be carried out in conjunction with an automatic roving bobbin exchange apparatus.

An advantage of the present invention is that it creates a very efficient information system for the operation of textile spinning installations in which system multiple-stage signals provide for improved job differentiation for operators and automatic equipment. So-called guidance-aid stages are the result. Guidance aids denote an information system through which a servicing element is requested to take action and/or it is directed to a station that requires servicing. Use can be made here of signals transmitted electrically for automatic servicing equipment, while operators can be alerted by optical signals, such as lamps that can be switched on and off, or by acoustic means such as horns or voice communication. Classification into stages of the guidance-aid instructions means that a higher-ranking servicing element will be directed to a station needing service only if the servicing case cannot be corrected by the servicing element that is normally assigned such a servicing case. Automatic mobile traveling service units, such as for example conventional strand piecing devices, can be used in a spinning installation, such as a multi-station ring spinning machine, as servicing elements of the lowest rank. It can be assumed for a spinning installation equipped with these automatic piecing devices that these piecing devices can, with a proper relationship between the number of broken ends and the correction capacity of the piecing devices, qualitatively correct up to a predetermined number of occurrences of strand breaks without the need for operator intervention. Intervention of the operator is required only for strand breaks that the piecing devices cannot correct or if there is a high number of strand breaks exceeding the predetermined number.

Action by a servicing element in the operation of a ring spinning machine is normally required in the following situations: (a) there is at least one strand break, but it can be corrected with respect to type and possibly number of a piecing device operating at the ring spinning machine; (b) there is at least one strand break that cannot be corrected by the piecing devices because of its type, for example, coil build-up or a broken traveler; (c) there are so many strand breaks that the piecing devices cannot correct them in a reasonable amount of time; (d) there is a servicing case, which also cannot be corrected by the operator, and requires intervention by the spinning foreman, for example.

The guidance aid according to the present invention is based on a servicing element ranking hierarchy preferably having three stages, for example: (1) automatic traveling service unit, e.g. a strand piecing device as the lowest ranking servicing element; (2) an operator or comparable personnel as the next higher ranking servicing element; and (3) a foreman or like superior to the operator, as the highest ranking servicing element. According to this predetermined hierarchy, a servicing case that cannot be corrected by one servicing element is deemed to be correctable by the servicing element of the next higher rank, and a servicing element of a higher rank can also correct servicing cases that can be corrected by each lower-ranking servicing element. Of course, two-stage rankings are also possible.

Based on this ranking, three stages of signals are utilized as intervention instructions that can be differentiated for the three ranks of the servicing elements and that can at the same time serve as information about the employment of a servicing element for higher-ranking servicing elements: (1) a first-level signal stage indicating occurrence of a strand break which does not require intervention of the operator; (2) a second-level signal stage indicating occurrence of a strand break or other servicing case for which intervention of the operator is required; and (3) a third-level signal stage indicating a strand break or other servicing case which requires intervention of the foreman.

Since the first stage of servicing cases requires no operator intervention and is of an informational nature only, indication thereof can sometimes be eliminated. However, since the piecing devices can be temporarily out of service, in which case strand breaks must be corrected by the operator alone, it is normally necessary or advisable that the guidance-aid apparatus be adapted for indicating first-stage servicing cases.

With reference now to FIG. 1, a ring spinning machine 1 having a plurality of spinning stations is shown wherein each spinning station is equipped with a strand break sensor 2 which may be of any conventional type. These strand break sensors 2 are arranged along opposite sides of the spinning machine and are connected respectively through circuits 14 and 15 with a control unit 6, which in turn is connected with an indicator 7. In this manner, strand break signals of the thread break sensors 2 are conducted to the control unit 6 at least separately for each side of the spinning machine in order to assign a job instruction to the job location. As will be understood, it is also contemplated that strand break signals may be transmitted by smaller groups or sections of the spinning stations as well. According to the present invention the indicator 7 must be able to give up to three distinguishable signals and therefore the indicator 7 may be provided with three signal lamps, for example, in different colors. Also provided is a key 5 connected with the control unit 6, described more fully hereinafter.

A piecing device 3 may be provided for traveling movement along the ring spinning machine 1 for correcting certain strand breaks and the piecing device 3 may be connected through a sliding contact 13 with a bus-bar 4 leading to the control unit 6 to enable to the piecing device 3 to transmit signals to the control unit 6.

It is also possible, to superimpose signals to be conducted from the piecing device 3 to the control unit 6 as high-frequency signals in the power supply of the piecing device 3. In the case of automatic correction of strand breaks by a piecing device 3, the control unit 6 can direct the piecing device 3 to a pertinent spinning station where a strand has broken and cause the indicator 7 to indicate the aforementioned first signal stage indicating the existence of a strand break or breaks which are assumed do not require action by an operator. It is also possible that this first signal stage may be eliminated, such as when the piecing device 3 itself is utilized to travel along the spinning machine to search for spinning stations requiring service.

Figure 2:
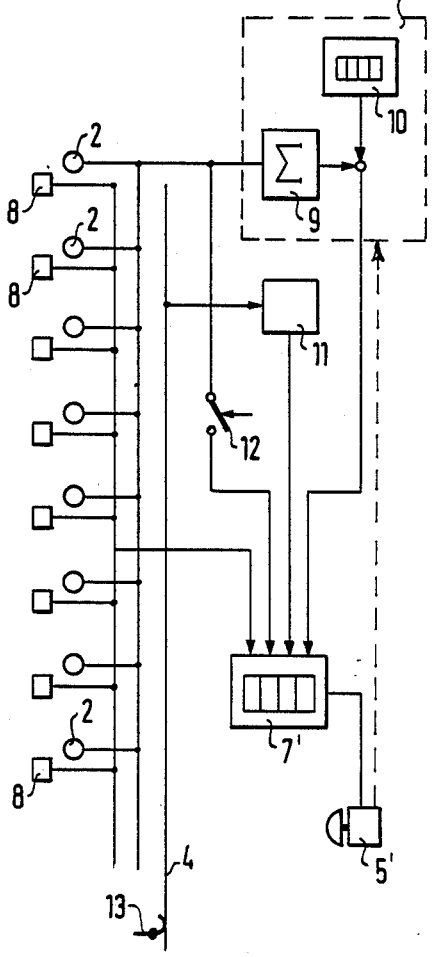
FIG. 2 is another embodiment of the present apparatus arranged for the present method of automatic and separate detection of existing servicing cases by both thread break sensors and coil sensors.

When a piecing device is utilized for automatic correction of strand breaks, the sum of the existing breaks may be formed in the control unit 6 and compared with an adjustable maximum figure. For this purpose, as seen in FIG. 2, each thread break sensor 2 may be connected with a summing apparatus 9, which is in turn connected with a preselector 10 for setting a predetermined maximum strand break figure. The aforesaid second-level signal stage is indicated in the indicator 7' when the maximum figure is exceeded, that is, when the number of strand breaks is to high for the piecing device 3 to correct itself and the assistance of the operator is required.

The second-level signal stage may also be initiated when at least one strand break cannot be corrected by the piecing device 3. In such circumstances, the piecing device 3 may be set-up to stop its action at a spinning station following three unsuccessful piecing attempts and to report this fact through the signal circuit 4 to the control unit 6.

As also shown in FIG. 2, each spinning station of the ring spinning machine 1 may also be equipped with a coil sensor 8 which senses coil build-up at the delivery rollers (not shown) of the drafting systems of the spinning stations. These coil sensors 8 are connected in the same way as the strand break sensors 2 with a control unit 6. Since a coil build-up cannot be corrected by the piecing device 3, the control unit 6 will immediately cause indication of the second-level signal stage in the indicator 7' when a coil signal is received from a coil sensor 8, and the second-level signal stage will direct an operator to this station.

A key 5 or 5' can also be arranged at the ring spinning machine 1 for actuation by the operator. This key is connected with the control unit 6 or directly with the indicator 7'. If unable to correct a strand break or other servicing case, the operator will actuate this key, which will cause the indicator 7 or 7' to initiate the third-level signal stage to call the supervisor or foreman. All signals from the spinning station or from the piecing device 3 can be connected with a spindle address so that it is possible for the particular spinning station where a fault has occurred to be identified in the indicator 7 or 7'. For this purpose, the indicator 7 or 7' can have a display with one to four digits, depending on the number of digits assigned to the spindle address.

The bus-bar 4 is also connected with an apparatus 11 for recognition of strand breaks that cannot be corrected by the piecing device 3. The coil sensors 8 are connected through a circuit with the indicator 7'. In order to eliminate the need for two circuits for both the coil sensors 8 and the thread break sensors 2, the signals from the two types of sensors can be conducted through a single circuit to the control unit 6 and the indicator 7', whereby identification of the faults is distinguished, for example, through different coding. A switch 12 is provided in the circuit going from the strand break sensors 2 to the indicator 7'. The switch 12 can be used for switching over to manual strand break correction, as may be necessary, for example, if the piecing device 3 is out of service. When this switch 12 is closed, a strand break signal from one of the strand break sensors 2 will initiate an indication in the indicator 7' of the second-level signal stage.

Thus, the following servicing cases can be corrected through the process according to the invention and the corresponding apparatus:

I. If strand break sensors 2 are used, a strand break will be detected by the strand break detectors 2 at the spinning stations and the first-level signal stage will be initiated and indicated by the indicator 7,7' for information. The piecing device 3 or other suitable traveling service unit is activated. If the action of the service unit is unsuccessful or if its capacity is exhausted, e.g. there is a great number of strand breaks, the second-level signal stage is initiated by the indicator 7 or 7' so that action by an operator is requested. If action by the operator is unsuccessful or the servicing case is beyond his capabilities, the operator can press the key 5 or 5' to initiate the indication of the third-level signal stage, to call for foreman or supervisor action.

II. If the piecing device 3 or other traveling service unit is out of service, the switch 12 is closed by the operator. Then, if a strand break occurs, the second-level signal stage is immediately shown in the indicator 7 or 7' and operator action is called for. If such operator action is unsuccessful or capacity is exhausted, the operator can press the key 5 or 5' to initiate indication of the third-level signal stage.

III. If the operator is temporarily unavailable, this person's activity can be assumed by a replacement or by the foreman or supervisor. In the latter case, a signal call for the operator may be automatically switched over to the third-level signal stage by a switch-over unit (not shown) in the control unit 6, thereby skipping the second-level signal stage.

IV. It is also possible that both the piecing device 3 or other traveling servicing unit and the operator will be unavailable so that a replacement person must take action in any event. In this case, provision may be made to skip both the first and second signal stages automatically.

V. If use is made of a piecing device 3 or other traveling service unit of the type having its own strand break sensor, a strand break may be detected either by strand break sensors 2 specific to the spinning stations or by the strand break sensor of the traveling service unit. Detection of the strand breaks is necessary or desirable to determination of an overload condition for the service unit or operator. In this case, the operating sequence is again as in the aforementioned first case I; that is, if the traveling service unit is unsuccessful in correcting a stand break or the capacity of the unit is exceeded, the second-level signal stage is indicated and, if necessary, the third-level signal stage may be indicated. In this case, indication of the first-level signal stage is not necessary as long as the traveling service unit is operating. However, provision must be made for a switch-over to the second or third-level signal stage if the traveling service unit is unavailable. If one or both of the traveling service unit and the operator are unavailable, the process sequence is the same as in cases II to IV.

VI. It is also possible to use strand breaks sensors 2 specific to the spinning stations without a traveling service unit being used, this situation being similar to that of the aforementioned case II.

VII. If strand break sensors 2 specific to the spinning stations are not used, but a traveling service unit with thread break sensor is used, a possible strand break will be detected by the strand break sensor of the service unit and the service unit will be activated. If the service unit is unsuccessful in correcting the break or its capacity is exceeded, a switch-over to the second-level signal stage is indicated through the indicator 7 or 7'. The operator takes action and, if he is unsuccessful or incapable of correcting the servicing required, the third-level signal stage will be indicatetd to call the foreman. If the traveling service unit becomes unavailable, the operator can detect any strand break visually and take action. If necessary, the third-level signal stage is also available. On the other hand, if the operator is unavailable, any strand break will be detected by the strand break sensor of the traveling service unit whereupon the service unit is activated. If the service unit is unsuccessful or its capacity is exceeded, the second-level signal stage will be activated and, in this case, the foreman must be aware of the fact that this second-level signal stage requires action on his part or the second-level signal stage must be switched over to the third-level signal stage. It is of course possible that a number of the first, second and third-level signals may be given at the same time.

In any case, the process according to the invention ensures that servicing cases existing in a spinning installation will automatically be detected separately according to type and correction requirement, and, depending on number and degree of difficulty of the servicing cases detected, a job instruction signal of one of at least two possible signal stages is indicated in the indicator 7 or 7' and is transmitted to a correspondingly associated servicing element according to a ranking of servicing elements, for example, a ranking of traveling service unit, operator, and foreman. This results in a considerable increase in efficiency in correction of damage in a spinning installation.

In order to detect a very high number of strand breaks requiring the intervention of an operator, it is also possible to compare the actual cycle time of an automatic piecing device 3 with a predetermined cycle time desired to be maintained with a normal frequency of strand breaks. If the desired cycle time is exceeded by a certain amount, this occurrence may be deemed to indicate excessive strand breaks requiring the second-level signal stage to be indicatetd. This comparison can be carried out in the control unit 6 which may be provided with an adjustable time setting (not shown) that is started when the traveling service unit passes a certain point. If the traveling service unit does not pass this point again until after the pre-set time expires, i.e. the actual cycle time is longer than the pre-set time, then the second-level signal stage is indicated. It is also contemplated that the indicator 7 or 7' may be connected with a printer for recording process sequences and other operating data.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A process for job control of a plurality of servicing elements at a textile spinning installation having a plurality of servicing locations, wherein existing servicing cases are detected and analyzed for controlling their correction, characterized by the steps of ranking the servicing elements according to their respective capabilities for correcting differing servicing cases, automatically detecting existing servicing cases separately according to number and correction requirement, and, depending on number and degree of difficulty of the servicing cases detected, transmitting a job instruction signal to the servicing element having the correction capability corresponding to the existing servicing cases detected, the job instruction signal being one of at least two signal stages each of which is respectively associated with a corresponding one of the ranked servicing elements.

2. A process in accordance with claim 1, characterized further by determining the signal stage transmitted for a detected servicing case according to the ranking of servicing element having the servicing capability required for qualitatively correcting the detected servicing case.

3. A process in accordance with claim 1, characterized further by determining the signal stage transmitted for a number of detected servicing cases according to the ranking of servicing element having the servicing capability for qualitatively and quantitatively correcting the detected servicing cases.

4. A process in accordance with claim 1, characterized further by, when the servicing element of one rank in the ranking of the servicing elements is not available, converting the signal stage associated with the unavailable servicing element into the signal stage of the servicing element associated with the next higher rank.

5. A process in accordance with claim 1, characterized further by providing a graduated three-stage ranking of servicing elements consisting of an automatic traveling servicing unit as the lowest ranking servicing element, an operator as the next ranking servicing element, and a supervisor as the highest ranking servicing element.

6. Apparatus for job control of a plurality of servicing elements at a textile spinning installation having a plurality of servicing locations, including means for detecting and analyzing existing servicing cases for controlling their correction, characterized by means for establishing a ranking of the servicing elements according to their respective capabilities for correcting differing servicing cases, means for automatically detecting existing servicing cases separately according to number and correction requirement, and means for transmitting a job instruction signal to the servicing element having the correction capability corresponding to the existing servicing cases detected depending on the number and degree of difficulty thereof, the job instruction signal being one of at least two signal stages each of which is respectively associated with a corresponding one of the ranked servicing elements, said transmitting means comprising a summing device for summing existing servicing cases, a comparator for comparing the sum of existing servicing cases with a preset number of servicing cases, and at least one indicator connected with both the comparator and the detecting means, said indicator having at least two indicator stages which are switchable as a function of the servicing element required for correcting the servicing cases detected.

7. An apparatus in accordance with claim 6, characterized further in that said detecting means comprises sensors arranged at each servicing point to sense an existing servicing case.

8. An apparatus in accordance with claim 6, characterized further by timer means for measuring the cycle time of one of the servicing elements correcting the servicing cases.

9. An apparatus in accordance with claim 6, characterized further in that said detecting means includes a detector for detecting servicing cases which are not correctable by the servicing element of the lowest rank, said detector including means for reporting a servicing case as uncorrectable by the lowest ranking servicing element after a predetermined number of unsuccessful servicing attempts.

10. An apparatus in accordance with claim 9, characterized further in that said predetermined number is a selectable positive whole number between 2 and 5.

11. An apparatus in accordance with claim 6, characterized further in that said detecting means includes a detector for detecting servicing cases that cannot be corrected by an operator, said detector comprising a switch for actuation by the operator.

12. An apparatus in accordance with claim 7, characterized further in that said sensors are operatively connected with the indicator through the summing means.

13. An apparatus in accordance with claim 6, characterized further by a preselector for setting said preset number of servicing cases, the comparator being connected with the preselector.

14. An apparatus in accordance with claim 6, characterized further in that said detecting means is arranged for supplying servicing instructions to said transmitting means separately by sections of said spinning installation.

15. An apparatus in accordance with claim 6, characterized further in that said spinning installation has a plurality of spinning stations each of which has a drafting system having delivery rollers, said detecting means including a coil sensor at each spinning station for sensing coil build-up at the delivery rollers thereat, the coil sensors being connected with the indicator to separately indicate the number and the types of servicing cases ascertained by the coil sensors.

16. An apparatus in accordance with claim 6, characterized further in that one said servicing element is an automatic traveling service unit arranged for movement along said spinning installation, said traveling service unit being opeatively connected with the indicator to separately indicate the number and the types of servicing cases ascertained by the traveling service unit.

17. An apparatus in accordance with claim 16, characterized further by a slide contact mounted to the traveling service unit and a separate bus-bar mounted along the spinning installation for operative contact with the slide contact and being operatively connected with the indicator.

18. An apparatus in accordance with claim 16, characterized further by means for transmitting high frequency signals from the traveling service unit to the indicator.

19. Apparatus in accordance with claim 16, characterized further in that the traveling service unit comprises means for automatic piecing together of broken strands.

20. An apparatus in accordance with claim 16, characterized further in that the traveling service unit comprises means for automatically performing roving bobbin exchange operations.

21. An apparatus in accordance with claim 6, characterized further by a printer operatively connected with the indicator for recording operating data.

* * * * *